US005116199A

United States Patent [19]

Ciokajlo

[11] Patent Number: 5,116,199

[45] Date of Patent: May 26, 1992

[54] BLADE TIP CLEARANCE CONTROL APPARATUS USING SHROUD SEGMENT ANNULAR SUPPORT RING THERMAL EXPANSION

[75] Inventor: John J. Ciokajlo, Cincinnati, Ohio

[73] Assignee: General Electric Company, Cincinnati, Ohio

[21] Appl. No.: 630,651

[22] Filed: Dec. 20, 1990

[51] Int. Cl.[5] ..... F01D 5/20

[52] U.S. Cl. ..... 415/173.2; 415/116

[58] Field of Search ..... 415/115, 116, 134, 136, 415/138, 139, 173.1, 173.2, 173.3, 174.1

[56] References Cited

U.S. PATENT DOCUMENTS

| | | | |
|---|---|---|---|
| 3,864,056 | 2/1975 | Gabriel et al. | 415/116 |
| 4,251,185 | 2/1981 | Karstensen . | |
| 4,363,599 | 12/1982 | Cline et al. . | |
| 4,379,677 | 4/1983 | Hallinger et al. . | |
| 4,527,385 | 7/1985 | Jumelle et al. . | |
| 4,553,901 | 11/1985 | Laurello . | |
| 4,573,866 | 3/1986 | Sandy, Jr. et al. | 415/116 |
| 4,642,024 | 2/1987 | Weidner . | |
| 4,683,716 | 8/1987 | Wright et al. . | |
| 4,826,897 | 5/1989 | Shook et al. . | |
| 4,844,688 | 7/1989 | Clough et al. . | |
| 4,859,142 | 8/1989 | Burke et al. . | |
| 4,893,984 | 1/1990 | Davison et al. . | |
| 5,035,573 | 7/1991 | Tseng et al. | 415/173.2 |

FOREIGN PATENT DOCUMENTS

| | | | |
|---|---|---|---|
| 2540937 | 8/1984 | France | 415/115 |

*Primary Examiner*—Edward K. Look
*Assistant Examiner*—Christopher M. Verdier
*Attorney, Agent, or Firm*—Jerome C. Squillaro

[57] ABSTRACT

An apparatus for controlling clearance between rotor blade tips and shroud segments of a turbine engine casing includes an annular channel extending about the blade tips and having an annular opening located outwardly of and adjacent the blade tips, and separate shroud segments composing the shroud and disposed across the channel opening in circumferential spaced relation. Inlet and outlet tubular members mounted to the casing have inner portions projecting radially inwardly into the annular channel. An annular hollow ring disposed in the annular channel mounts the shroud segments across the channel opening and are mounted to the tubular member inner portions for undergoing movement radially outwardly and inwardly relative to the inner portions in response to thermal expansion and contract of the annular ring. Tubular inlet members introduce a cooling gas into the annular channel from the exterior and tubular outlet members exhausts the cooling gas from the annular channel to the exterior. Hollow manifolds disposed within the annular channel in the annular ring are connected with the inner portions of the tubular inlet members for receiving cooling air. Each manifold has jet-like apertures permitting impingement of cooling air upon the annular ring. After such impingement, the cooling air can flow from the annular ring through the tubular outlet members to the exterior.

18 Claims, 6 Drawing Sheets

BLADE TIP CLEARANCE CONTROL APPARATUS USING SHROUD SEGMENT ANNULAR SUPPORT RING THERMAL EXPANSION

CROSS-REFERENCE TO RELATED APPLICATIONS

Reference is hereby made to the following copending U.S. patent applications dealing with related subject matter and assigned to the assignee of the present invention:

1. "Blade Tip Clearance Control Apparatus For A Gas Turbine Engine" by John J. Ciokajlo, assigned U.S. Pat. Ser. No. 07/405,369 and filed Sept. 8, 1989.
2. "Mechanical Blade Tip Clearance Control Apparatus For A Gas Turbine Engine" by John J. Ciokajlo et al, assigned U.S. Pat. Ser. No. 07/404,923 and filed Sept. 8, 1989.
3. "Blade Tip Clearance Control Apparatus Using Bellcrank Mechanism" by Robert J. Corsmeier et al, assigned U.S. Pat. Ser. No. 07/440,633 and filed Nov. 22, 1989.
4. "Blade Tip Clearance Control Apparatus Using Cam-Actuated Shroud Segment Positioning Mechanism" by Robert J. Corsmeier et al, assigned U.S. Pat. Ser. No. 07/482,139 and filed Feb. 20, 1990.
5. "Blade Tip Clearance Control Apparatus Using Shroud Segment Position Modulation" by Robert J. Corsmeier et al, assigned U.S. Pat. Ser. No. 07/480,198 and filed Feb. 12, 1990.
6. "Blade Tip Clearance Control Apparatus With Shroud Segment Position Adjustment By Unison Ring Movement" by Robert J. Corsmeier et al, assigned U.S. Pat. Ser. No. 07/507,428 and filed Mar. 21, 1990.

BACKGROUND OF THE INVENTION

1. Field of the Invention

The present invention relates generally to gas turbine engines and, more particularly, to an apparatus for controlling clearance between adjacent rotating and non-rotating components of a gas turbine engine.

2. Description of the Prior Art

The efficiency of a gas turbine engine is dependent upon many factors, one of which is the radial clearance between adjacent rotating and non-rotating components, such as, the rotor blade tips and the casing shroud surrounding the outer tips of the rotor blades. If the clearance is too great, an unacceptable degree of gas leakage will occur with a resultant loss in efficiency. If the clearance is too little, there is a risk that under certain conditions contact will occur between the components.

The potential for contact occurring is particularly acute when the engine rotational speed is changing, either increasing or decreasing, since temperature differentials across the engine frequently result in the rotating and non-rotating components radially expanding and contracting at different rates. For instance, upon engine accelerations, thermal growth of the rotor typically lags behind that of the casing. During steady-state operation, the growth of the casing ordinarily matches more closely that of the rotor. Upon engine decelerations, the casing contracts more rapidly than the rotor.

Control mechanisms, usually mechanically or thermally actuated, have been proposed in the prior art to maintain blade tip clearance substantially constant. However, these prior art control mechanism have drawbacks. Mechanical mechanisms typically are complex and, although capable of responding quickly, are subject to vibration and mechanical tolerance "stack-ups". Thermal mechanisms typically require thermally radially moving structural casings by air impingement on the casings and thus require thermal brute force to radially move structural casing shells and flanges/rings over an inordinately long period of time, such as up to three minutes. Thus, none of the prior art control mechanisms are believed to represent the optimum design for controlling clearance.

Consequently, a need still remains for an improved mechanism for clearance control that will improve engine performance and reduce fuel consumption.

SUMMARY OF THE INVENTION

The present invention provides a blade tip clearance control apparatus which satisfies the aforementioned needs and achieves the foregoing objectives. Further, the blade tip clearance control apparatus achieves these objectives without a large increase in weight. The blade tip clearance control apparatus employs a shroud segment annular support ring and a series of manifolds which direct impingement of cooling air on the annular support ring and provide fast response thermal expansion or contraction of the support ring for changing the position the shroud segments to maintain them at the desired clearance with the rotating turbine blades.

Accordingly, the clearance control apparatus of the present invention is provided in a gas turbine engine which includes a rotatable rotor having a central axis and a row of blades with outer tips and a stationary casing with a shroud disposed in concentric relation with the rotor. The clearance control apparatus, operable for controlling the clearance between the rotor blade tips and the casing shroud, comprises: (a) means on the casing disposed radially outwardly of the rotor blade tips for defining an annular channel extending in circumferential relation to the rotor central axis about the rotor blade tips and having an annular opening located outwardly of and adjacent to the rotor blade tips; (b) at least one shroud segment disposed across the opening of the annular channel; (c) means in the form of a pair of tubular inlet and outlet members mounted on the casing for respectively introducing a cooling gas into the annular channel from the exterior thereof and exhausting the cooling gas from the annular channel to the exterior thereof; (d) an annular hollow ring disposed in the annular channel and extending in circumferential relation to the rotor central axis, the annular ring mounting the shroud segment across the opening of the channel and, in turn, being mounted to the tubular inlet and outlet members for undergoing movement radially outwardly and inwardly relative to the blade tips and the tubular members in response to thermal expansion and contract of the annular ring; and (e) means disposed within the annular channel in the annular ring and being connected in communication with only the inlet member for receiving cooling gas, the receiving means defining a plurality of jet-like apertures for causing communication of the cooling gas from the interior to the exterior of the receiving means and impingement of the cooling gas upon portions of the annular ring adjacent to the apertures such that after such impingement the cooling gas can flow from the annular ring through the outlet member to the exterior of the annular channel.

More particularly, the receiving means is at least one hollow manifold having the apertures and also a plurality of protrusions projecting outwardly from the exterior thereof for engaging the interior of the annular ring to define a space for flow of the cooling air between the annular ring interior and the exterior of the manifold. Further, the annular ring includes a pair of annular parts each defining one of a pair of opposite side walls of the ring. One of the annular parts also defines an outer wall of the ring, whereas the other of the annular parts defines an inner wall of the ring. The outer wall of the one annular part of the ring includes a pair of tubular portions interfitting with the tubular inlet and outlet members so as to permit differential movement of the annular ring relative to the tubular inlet and outlet members upon thermal expansion and contraction of the annular ring. At least one sealing ring is mounted about each of the tubular inlet and outlet members. The sealing ring is capable of circumferentially expanding and contracting as the annular ring undergoes thermal expansion and contraction for maintaining a seal between the annular ring and the tubular inlet and outlet members.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
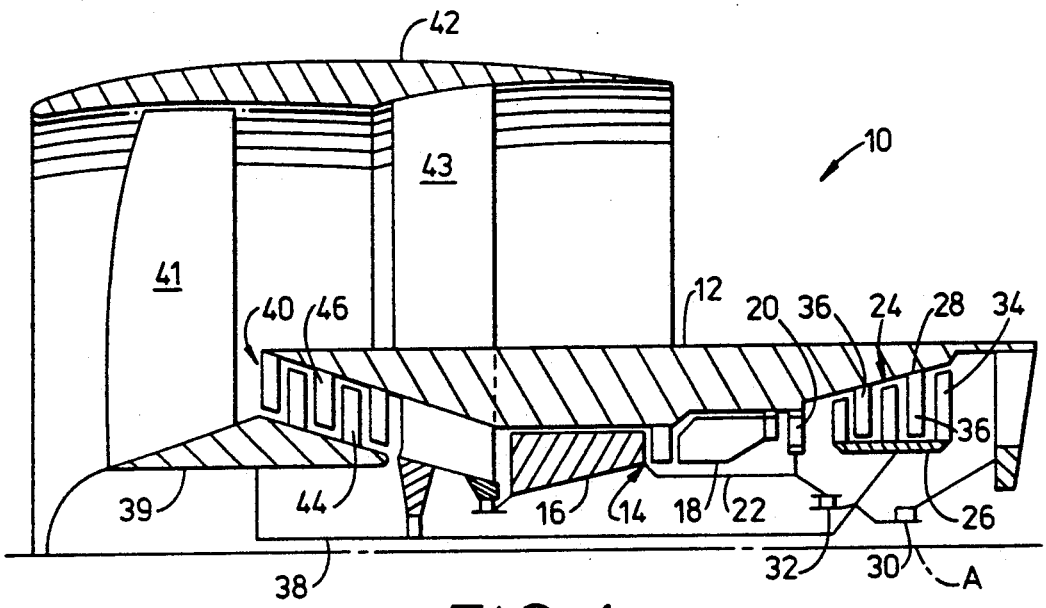
FIG. 1 is a schematic view of a gas turbine engine.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

In General

Referring now to the drawings, and particularly to FIG. 1, there is illustrated schematically a gas turbine engine, generally designated 10, to which the present invention can be applied. The engine 10 has a longitudinal center line or axis A and an annular casing 12 disposed coaxially and concentrically about the axis A. The engine 10 includes a core gas generator engine 14 which is composed of a compressor 16, a combustor 18, and a high pressure turbine 20, either single or multiple stage, all arranged coaxially about the longitudinal axis or center line A of the engine 10 in a serial, axial flow relationship. An annular drive shaft 22 fixedly interconnects the compressor 16 and high pressure turbine 20.

The core engine 14 is effective for generating combustion gases. Pressurized air from the compressor 16 is mixed with fuel in the combustor 18 and ignited, thereby generating combustion gases. Some work is extracted from these gases by the high pressure turbine 20 which drives the compressor 16. The remainder of the combustion gases are discharged from the core engine 14 into a low pressure power turbine 24.

The low pressure turbine 24 includes an annular drum rotor 26 and a stator 28. The rotor 26 is rotatably mounted by suitable bearings 30 and includes a plurality of turbine blade rows 34 extending radially outwardly therefrom and axially spaced. The stator 28 is disposed radially outwardly of the rotor 26 and has a plurality of stator vane rows 36 fixedly attached to and extending radially inwardly from the stationary casing 12. The stator vane rows 36 are axially spaced so as to alternate with the turbine blade rows 34. The rotor 26 is fixedly attached to drive shaft 38 and interconnected to drive shaft 22 via differential bearings 32. The drive shaft 38, in turn, rotatably drives a forward booster rotor 39 which forms part of a booster compressor 40 and which also supports forward fan blade rows 41 that are housed within a nacelle 42 supported about the stationary casing 12 by a plurality of struts 43, only one of which is shown. The booster compressor 40 is comprised of a plurality of booster blade rows 44 fixedly attached to and extending radially outwardly from the booster rotor 39 for rotation therewith and a plurality of booster stator vane rows 46 fixedly attached to and extending radially inwardly from the stationary casing 12. Both the booster blade rows 44 and the stator vane rows 46 are axially spaced and so arranged to alternate with one another.

Clearance Control Apparatus of the Prior Art

Figure 2:
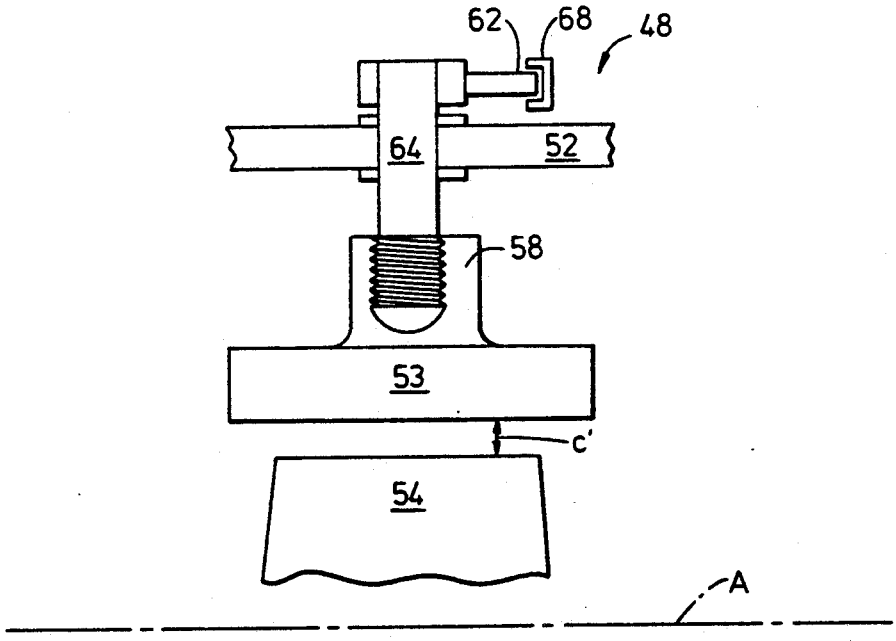
FIG. 2 (PRIOR ART)
FIG. 2 is a longitudinal axial sectional view of one prior art mechanical apparatus for controlling rotor blade tip and stator casing shroud clearance.
Figure 3:
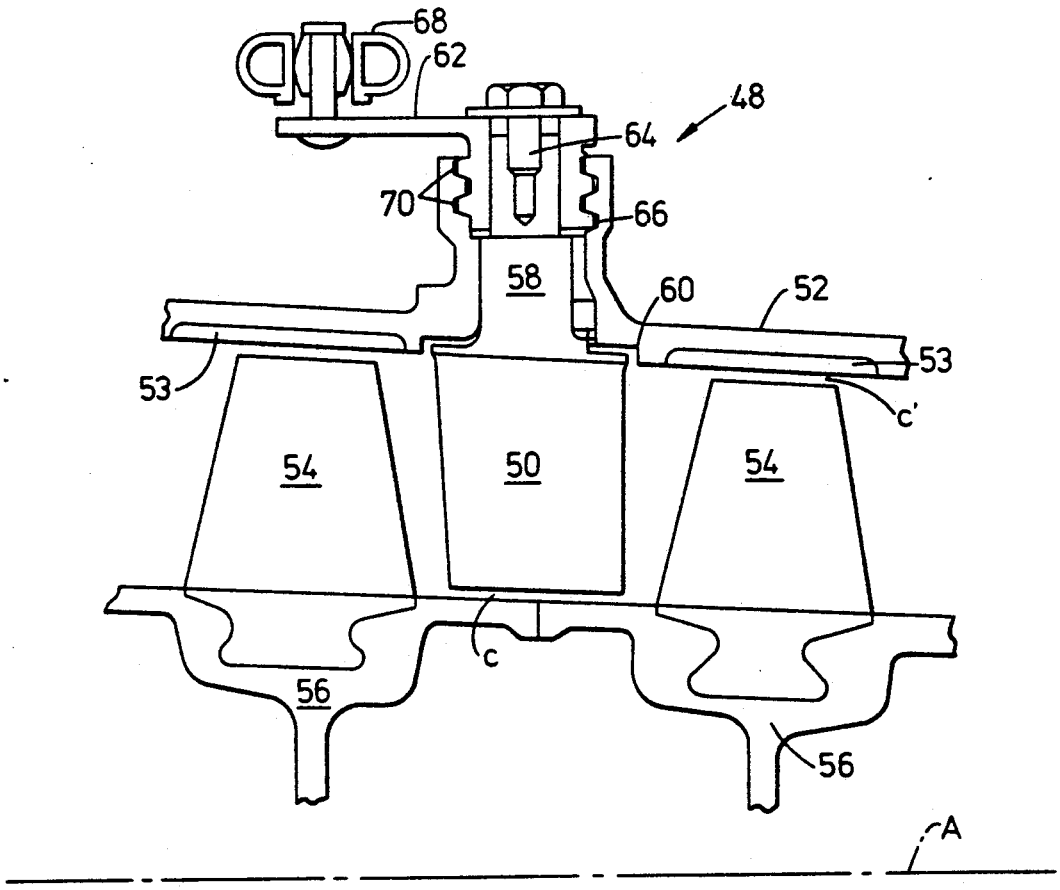
FIG. 3 (PRIOR ART)
FIG. 3 is a longitudinal axial sectional view of another prior art mechanical apparatus for controlling rotor and stator vane tip clearance.
Figure 4:
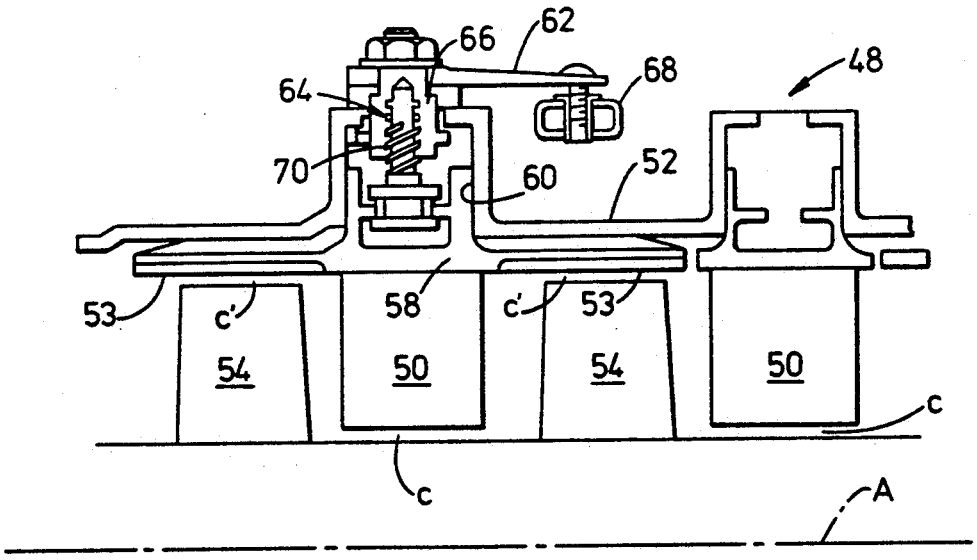
FIG. 4 (PRIOR ART)
FIG. 4 is a longitudinal axial sectional view of yet another prior art mechanical apparatus for controlling rotor blade tip and stator casing shroud clearance and rotor and stator vane tip clearance.

Referring now to FIGS. 2, 3 and 4, there is illustrated three variations of a prior art clearance control apparatus, generally designated 48 (disclosed on pages 8 and 15 of a publication entitled "Thermal Response Turbine Shroud Study" by E. J. Kawecki, dated July 1979, Technical Report AFAPL-TR-79-2087). The clearance control apparatus 48 is operable for changing the tip clearance gap C between the stator vanes 50, coupled on a stationary casing 52, and a rotatable rotor 56; and/or, the tip clearance gap C' between the rotatable rotor blades 54 and the casing shroud 53 of a gas turbine engine, such as the engine 10 just described.

In the FIG. 2 embodiment, the shroud segment 53 is separate from the casing 52 and is mounted on the end of a screw 64 for radial movement relative to the casing 52 toward and away from the tip of the rotor blade 54 for adjustment of the clearance gap C' therebetween. In the FIGS. 3 and 4 embodiments, the stator vanes 50 are mounted on shanks 58 which, in turn, are disposed in openings 60 in the casing 52 for radial movement toward and away from the rotor 56. Each shank is coupled to a lever arm 62 by the screw 64 threaded into a fitting 66 attached to the casing 52. Also, a unison ring 68 upon circumferential movement rotates the screw 64 via the lever arm 62 in order to adjust the clearance gap. To reduce the effects of thermal expansion on the clearance control apparatus 48, each screw 64 has threads 70 of a square cross section. In each of these embodiments, the shroud segment 53 is attached to the stationary casing 52 with the shroud segment 53 being fixedly attached in the FIG. 3 embodiment and movably attached in the FIG. 4 embodiment.

It should be noted that in the FIG. 3 embodiment, the clearance control apparatus 48 operates to adjust the clearance gap C between the tip of the stator vane 50 and the rotor 56, but does not adjust the clearance gap C' between the tip of the rotor blade 54 and the shroud segment 53. However, in the FIG. 4 embodiment, operation of the clearance control apparatus 48 not only adjusts the clearance gap C between the tip of the stator vane 50 and the rotor 56, but also, simultaneously therewith, adjusts the clearance gap C' between the tip of the rotor blade 54 and the shroud segment 53.

Clearance Control Apparatus of Present Invention

Turning now to FIGS. 5-9, there is illustrated a clearance control apparatus, generally designated 72, in accordance with the present invention. This apparatus 72 can advantageously be used with all compressor and turbine rotors of a gas turbine engine, such as the engine 10 illustrated in FIG. 1, where the rotors have smooth shrouded outer flowpaths and where rotor blade tip to shroud operating minimum clearances are required over the operating range of the engine. Also, the clearance control apparatus 72 is applicable to either aircraft or land based gas turbine engines.

The clearance control apparatus 72 includes a plurality of segments 74A of an annular shroud 74 (FIG. 9) of a stationary casing 76 and is operable for controlling the gap or clearance G between the shroud segments 74A and the outer tips 78A of a plurality of blades 78 of a rotary rotor 80 which rotates about a central axis B. The blades 78 extend radially outwardly in alternating fashion between stator vanes 82 which, in turn, are stationarily attached to and extending radially inwardly from the casing 76. More particularly, as depicted in FIG. 9, the clearance control apparatus 72 is operable to modulate the radial positions of the shroud segments 74A relative to the rotor blade tips 78A to control the clearance G the entire 360 degrees around the stationary casing 76.

Figure 9:
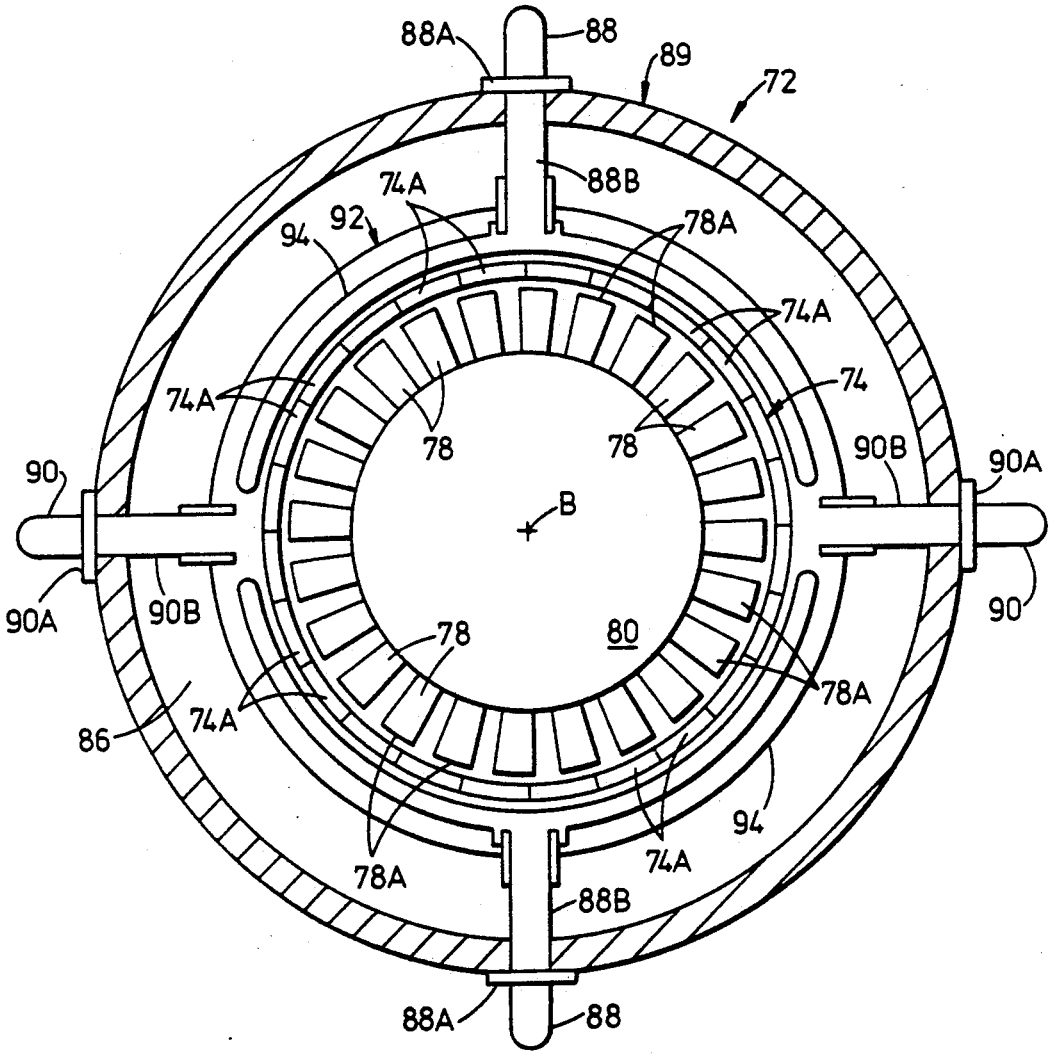
FIG. 9 is a schematic full circumferential view of the blade tip clearance control apparatus of the present invention.

The shroud segments 74A are elongated and arcuate in shape and, as seen in FIG. 9, define successive circumferential portions of the casing shroud 74. In addition to the shroud segments 74A, the clearance control apparatus 72 includes structural means 84 on the casing 76 for defining an annular hollow channel 86 extending in circumferential relation to the rotor central axis B about the rotor blade tips 78A. The annular channel 86 has an annular opening 86A located outwardly of and adjacent to the rotor blade tips 78A. As seen in FIG. 9, the separate shroud segments 74A are disposed across the opening 86A of the annular channel 86 in circumferential spaced relation to one another.

More particularly, the structural means 84 of the clearance control apparatus 72 includes first, second and third annular structures 84A, 84B, 84C on the casing 76. The first and second structures 84A, 84B on the casing 76 extend in circumferential relation to the rotor central axis B and are spaced axially from opposite leading and trailing edges of the rotor blade tips 78A. The third structure 84C on the casing 76 extends between and rigidly interconnects with the first and second structures 84A, 84B and is spaced radially outwardly of and remote from the rotor blade tips 78A. In such positional relationships, the first, second and third structures 84A, 84B, 84C define the annular hollow channel 86.

Figure 5:
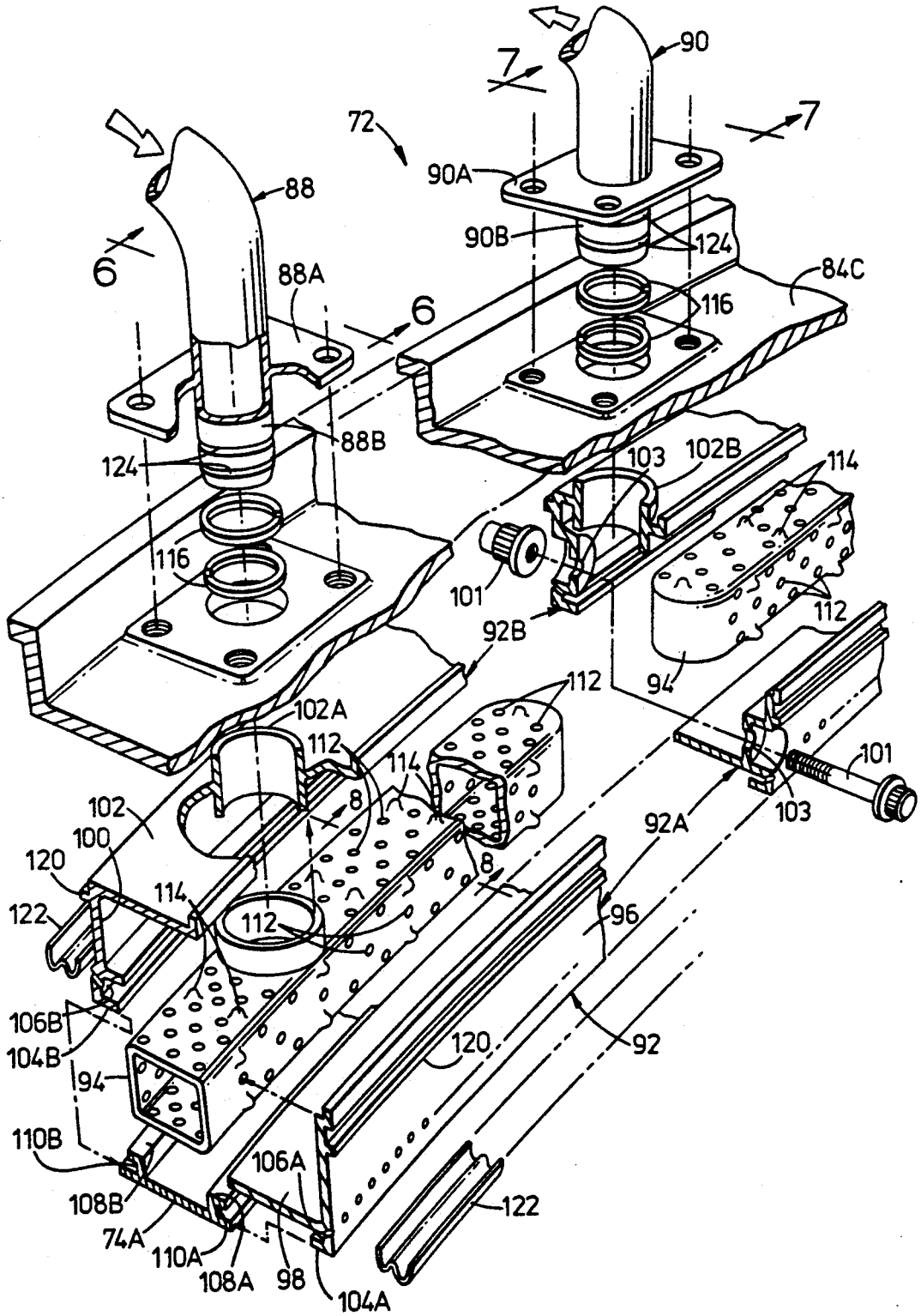
FIG. 5 is an exploded fragmentary perspective view of a blade tip clearance control apparatus in accordance with the present invention.
Figure 6:
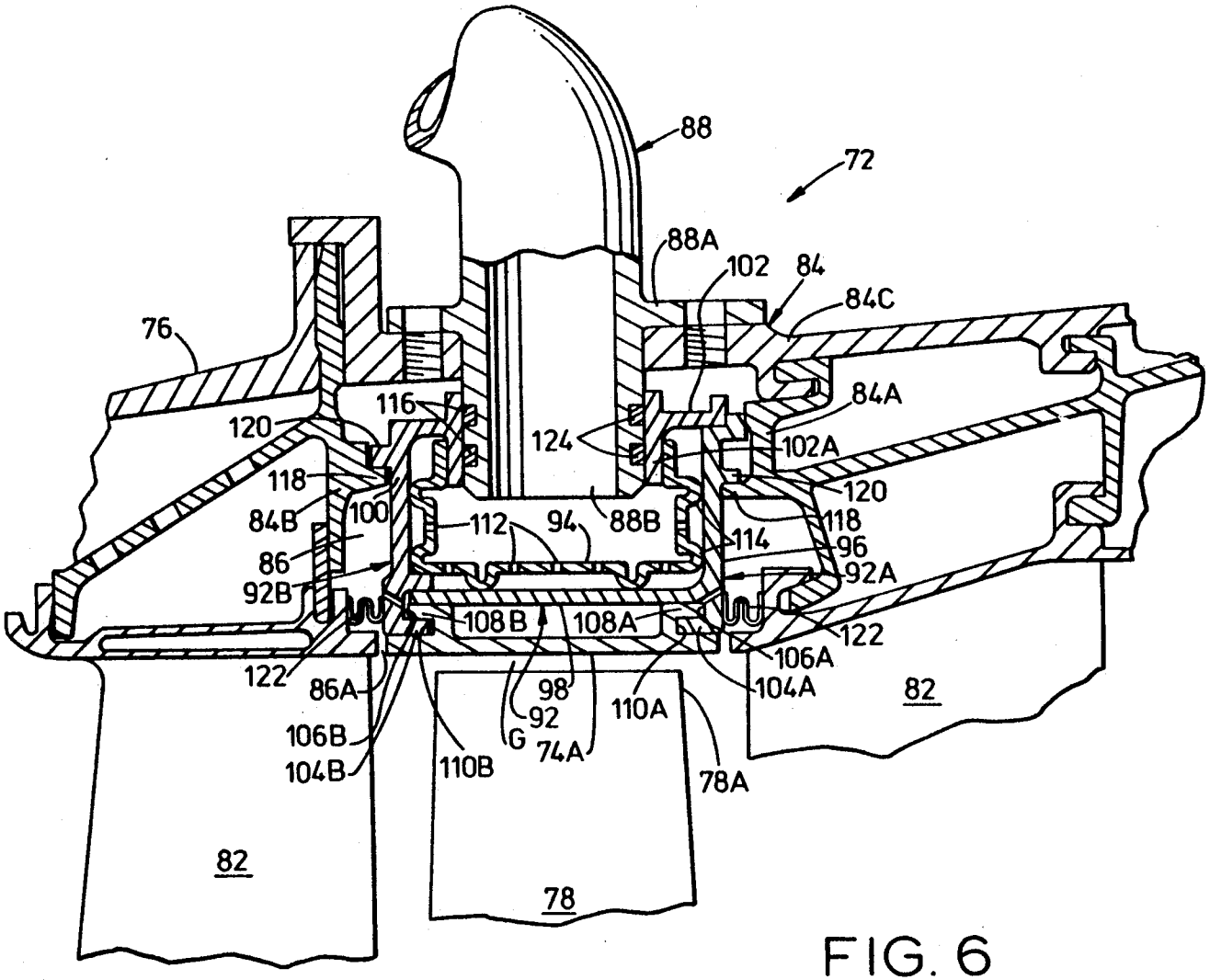
FIG. 6 is an enlarged fragmentary axial sectional view of the apparatus taken along line 6—6 of FIG. 5.
Figure 7:
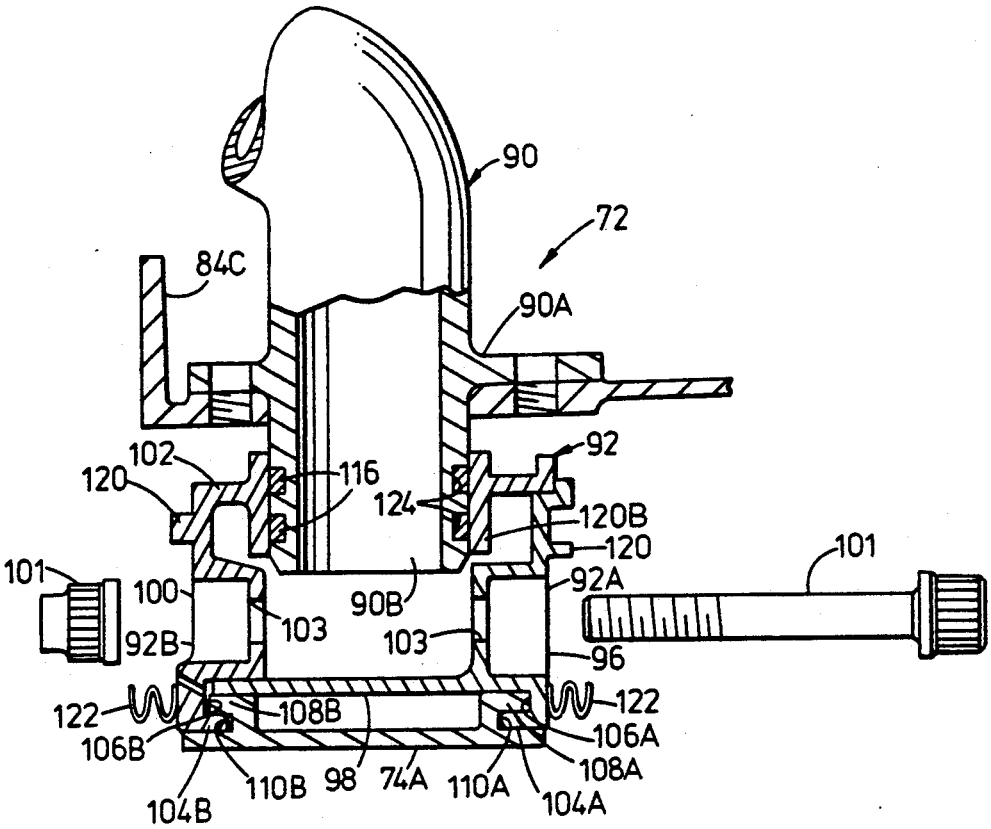
FIG. 7 is an enlarged fragmentary axial sectional view of the apparatus taken along line 7—7 of FIG. 5.
Figure 8:
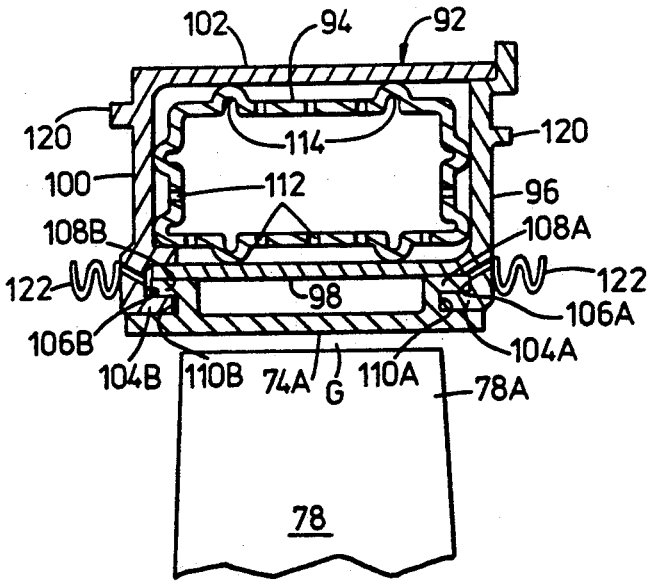
FIG. 8 is an enlarged fragmentary axial sectional view of the apparatus taken along line 8—8 of FIG. 5.

The clearance control apparatus 72 also includes means in the form of pairs of hollow tubular inlet and outlet members 88, 90 mounted on the casing 76 at the third structure 84C. The inlet member 88 communicates with a suitable external source (not shown) of cooling air on the turbine engine, such as the first or second stage of a compressor, for introducing the cooling gas into the annular channel 86 from the exterior thereof. The outlet member 90 communicates with ambient atmosphere or the fan duct of the turbine engine for exhausting the cooling gas from the annular channel 86 to the exterior thereof. As seen in FIGS. 5-7, the hollow tubular inlet and outlet members 88, 90 have outer flanges 88A, 90A by which the members are rigidly attached to the third structure 84C. The inlet and outlet members 88, 90 also have inner tubular end portions 88B, 90B which extend radially inwardly through the third structure 84C and into the annular channel 86.

The clearance control apparatus 72 further includes an annular hollow ring 92 disposed in the annular channel 86 and extending in circumferential relation to the rotor central axis B, and means in the form of a plurality of elongated hollow manifolds 94 disposed in the hollow ring 92. The annular ring 92 mounts the shroud segments 74A across the opening 86A of the annular channel 86 and, in turn, is mounted to the inner tubular end portions 88B, 90B of the pairs of tubular inlet and outlet members 88, 90. The annular hollow ring 92 is thus disposed in communication with the tubular cooling air inlet and outlet members 88, 90 and coupled thereto for undergoing movement radially outwardly and inwardly relative to the rotor blade tips 78A and the inner tubular end portions 88B, 90B in response to thermal expansion and contraction of the annular ring 92.

More particularly, the annular ring 92 of the clearance control apparatus 72 includes a pair of annular parts 92A, 92B each constituting approximately one-half of the structure of the ring 92. As seen in FIGS. 6 and 7, the right annular ring part 92A defines one opposite side wall 96 and an inner wall 98 of the ring 92, whereas the left annular ring part 92B defines the other opposite side wall 100 and an outer wall 102 of the ring 92. The right and left ring parts 92A, 92B are attached together by fasteners 101 inserted through holes 103 formed in the opposite side walls 96, 100, as seen in FIG. 7. Also, the outer wall 102 of the left annular ring part 92B includes a pair of tubular neck portions 102A, 102B which interfit with the inner tubular end portions 88B, 90B of the tubular inlet and outlet members 88, 90 so as to permit differential sliding movement of the annular ring 92 relative thereto upon thermal expansion and contraction of the annular ring 92. The right and left annular ring parts 92A, 92B also define flanges 104A, 104B and slots 106A, 106B which interfit with complementarily shaped flanges 108A, 108B and slots 110A, 110B formed along opposite side edges of the shroud segments 74A for mounting the segments on the ring.

The manifolds 94 of the clearance control apparatus 72 are disposed within the annular channel 86 in the annular ring 92. Each manifold 94 is connected in communication with only the tubular inlet member 88 for receiving cooling gas flow so as to prevent introduction of cooling gas flow into the annular ring 92 about the manifold 94 directly from the air inlet member 88 without first passing into the manifolds 94. Each manifold 94 is a hollow body with a plurality of spaced jet-like apertures 112 defined through it and distributed throughout. The apertures 112 permit communication of the cooling gas from the interior to the exterior of the manifold 94 and cause impingement of the cooling gas upon portions of the annular ring 92 disposed adjacent to the apertures 112. The manifolds 94 also have a plurality of spaced protrusions 114 projecting outwardly from the exterior of the manifold. The protrusions or dimples 114 are engaged with the interior of the annular ring 92 so as to define space for flow of the cooling air between the interior of the annular ring 92 and the exterior of the manifold 94. Therefore, after impingement of the cooling gas on the annular ring 92, the gas can then flow from the annular ring 92 through the tubular outlet member 90 to the exterior of the annular channel 86.

The clearance control apparatus 72 also includes a plurality of sealing piston rings 116, pairs of interengaging stop elements 118, 120 and expandable and contractible sealing elements 122. The sealing piston rings 116 are mounted in respective annular grooves 124 formed about each of the inner portions 88B, 90B of the tubular inlet and outlet members 88, 90. The sealing rings 116 are capable of circumferentially expanding and contracting as the annular ring 92 undergoes thermal expansion and contraction and thus moves relative to the inlet and outlet members 88, 90. In such manner, the sealing rings 116 maintain a seal between the annular ring 92 and the tubular inlet and outlet members 88,90 although the ring 92 is expanding and contracting relative thereto.

The interengagable elements 118, 120 are in the form of interengagable ledges on the first and second structures 84A, 84B and the annular ring 92. The ledges 118, 120 form stops to block and limit the amount of contraction and thus radially inward movement that the annular ring 92 and thereby the shroud segments 74A can undergo toward the rotor blade tips 78A.

The expandable and contractible sealing elements 122 are disposed in the annular channel 86 between the first and second structures 84A, 84B and the opposite sides of the annular ring 92. The sealing elements 122 provide a restriction to air flow through the annular channel 86 past the exterior of the annular ring 92 while permitting thermal expansion and contraction of the annular ring.

To summarize, the clearance control apparatus 72 controls clearance between the rotor blade tips 78A and the shroud segments 74A by thermal expansion and contraction of the annular hollow ring 92 disposed in the annular channel 86 and mounting the shroud segments 74A. The shroud segments 74A carried by the ring 92 and disposed across the chamber opening 86A undergo movement radially outwardly and inwardly away from and toward the rotor blade tips 78A as the annular ring 92 thermally expands and contracts in response controlled impingement of cooling air on the ring 92 to compensate for heating of the ring by operation of the engine. The flow of the cooling air is controlled by suitable conventional means not shown. The cooling air is introduced through the tubular inlet members 88 and exhausted through the tubular outlet members 90. The hollow manifolds 94 located within the annular ring 92 are designed to direct the impingement of the cooling air on the ring 92 in a uniform manner to effect the control of the thermal expansion and contraction of the annular ring 92 and hence the movement of the shroud segments 74A and thus the size of the clearance gap G between the segments 74A and the rotor blade tips 78A.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. In a gas turbine engine including a rotatable rotor having a central axis and a row of blades with outer tips and a stationary casing with a shroud disposed in concentric relation with said rotor, said rotor blade tips and casing shroud having a clearance therebetween, an apparatus for controlling the clearance between said rotor blade tips and casing shroud, said apparatus comprising:

(a) structural means on said casing disposed radially outwardly of said rotor blade tips for defining an annular channel extending in circumferential relation to said rotor central axis about said rotor blade tips and having an annular opening located outwardly of and adjacent to said rotor blade tips;

(b) at least one shroud segment disposed across said opening of said annular channel;

(c) means mounted on said casing for introducing a cooling gas flow into said annular channel from the exterior thereof and means mounted on said casing for exhausting the cooling gas flow from said annular channel to the exterior thereof;

(d) an annular hollow ring disposed in said annular channel and extending in circumferential relation to said rotor central axis, said annular ring mounting said shroud segment across said opening of said channel and, in turn, being mounted to and in communication with said introducing means and exhausting means for undergoing movement radially outwardly and inwardly relative the rotor blade tips and to said introducing means and exhausting means in response to thermal expansion and contraction of said annular ring; and (e) at least one manifold having an elongated hollow body disposed within said annular hollow ring in said annular channel and being connected at the interior of said hollow body of said manifold in communication with only said introducing means for receiving the cooling gas flow into the interior of said hollow body of said manifold so as to prevent introduction of the cooling gas flow into said annular ring about the exterior of said hollow body directly from said gas introducing means without first passing through said interior of said hollow body, said hollow body of said manifold having a plurality of jet-like apertures defined through said hollow body for permitting communication of the cooling gas flow from the interior to the exterior of said hollow body and impingement of the cooling gas flow upon portions of said annular ring adjacent to said apertures and the exterior of said hollow body such that after such impingement the cooling gas can flow directly from said annular ring through said exhausting means to the exterior of said annular channel without again passing through said interior of said hollow body of said manifold.

2. The apparatus as recited in claim 1, wherein said annular channel-defining means includes first and second structures on said casing spaced axially from one another, extending in circumferential relation to said rotor central axis, and spaced axially from opposite leading and trailing edges of said rotor blade tips.

3. The apparatus as recited in claim 2, wherein said annular channel-defining means further includes a third structure on said casing extending between and interconnecting said first and second structures and spaced radially outwardly of and remote from said rotor blade tips, said first, second and third structures defining said annular channel extending in circumferential relation to said rotor central axis and said annular opening of said channel.

4. The apparatus as recited in claim 1, further comprising:

a plurality of separate shroud segments composing said shroud and being disposed across said opening of said annular channel in circumferential spaced relation to one another.

5. The apparatus as recited in claim 1, wherein said introducing means is at least one hollow tubular inlet member and said exhausting means is at least one hollow tubular outlet member, said outlet member being mounted to said structural means on said casing and having an inner portion extending radially inwardly through said structural means and into said annular channel to said annular hollow ring disposed within said channel and said inlet member being mounted to said structural means on said casing and having an inner portion extending radially inwardly through said structural means and into said annular channel to said annular hollow ring disposed within said channel and therefrom into said hollow body of said manifold disposed within said annular hollow ring such that said tubular inlet member is capable of introducing the cooling gas flow directly into said interior of said hollow body of said manifold from the exterior of said annular channel and said tubular outlet member is capable of exhausting the cooling gas flow directly form the interior of said annular hollow ring to the exterior of said annular channel.

6. The apparatus as recited in claim 1, wherein said hollow body of said manifold also has a plurality of protrusions projecting outwardly from the exterior of said hollow body of said manifold for engaging the interior of said annular ring to define a space for flow of the cooling air between the annular ring interior and the exterior of said hollow body of said manifold.

7. The apparatus as recited in claim 5, wherein said annular ring includes a pair of annular parts each defining one of a pair of opposite side walls of said ring, one of said annular parts defining an outer wall of said ring, the other of said annular parts defining an inner wall of said ring.

8. The apparatus as recited in claim 7, wherein said outer wall of said one annular part of said annular ring includes a pair of tubular portions interfitting with said inner portions of said tubular inlet and outlet members so as to permit differential movement of said annular ring relative to said tubular inlet and outlet members upon thermal expansion and contraction of said annular ring.

9. The apparatus as recited in claim 8, further comprising:

at least one sealing ring mounted about each of said inner portions of said tubular inlet and outlet members and being capable of circumferentially expanding and contracting as said annular ring undergoes thermal expansion and contraction for maintaining a seal between said annular ring and said tubular inlet and outlet members.

10. The apparatus as recited in claim 1, further comprising:

interengagable elements on said annular channel-defining means and said annular ring for forming a stop to limit the amount of contraction and thus radially inward movement of said annular ring and said shroud segment toward the rotor blade tips.

11. The apparatus as recited in claim 1, further comprising:

a pair of expandable and contractible sealing elements disposed in said annular channel between said channel-defining means and opposite sides of said annular ring for providing a restriction to air flow through said channel past the exterior of said annular ring while permitting thermal expansion and contraction of said annular ring.

12. In a gas turbine engine including a rotatable rotor having a central axis and a row of blades with outer tips and a stationary casing with a shroud disposed in concentric relation with said rotor, said rotor blade tips and casing shroud having a clearance therebetween, an apparatus for controlling the clearance between said rotor blade tips and casing shroud, said apparatus comprising:

(a) first and second structures on said casing spaced axially from one another, extending in circumferential relation to said rotor central axis, and spaced axially from opposite leading and trailing edges of said rotor blade tips;

(b) a third structure on said casing extending between and interconnecting said first and second structures and spaced radially outwardly of and remote from said rotor blade tips, said first, second and third structures defining an annular channel extending in circumferential relation to said rotor central axis about said rotor blade tips and having an annular opening located outwardly of and adjacent to said rotor blade tips;

(c) a plurality of separate shroud segments composing said shroud and being disposed across said opening of said annular channel in circumferential spaced relation to one another;

(d) at least one hollow tubular inlet member and at least one hollow tubular outlet member mounted to said third structure on said casing and having inner portions extending radially inwardly through said third structure and into said annular channel, said tubular inlet member being capable of introducing a cooling gas flow into said annular channel from the exterior thereof and said tubular outlet member being capable of exhausting the cooling gas flow from said annular channel to the exterior thereof;

(e) an annular hollow ring disposed in said annular channel and extending in circumferential relation to said rotor central axis, said annular ring mounting said shroud segments across said opening of said channel and, in turn, being mounted to said inner portions of said hollow tubular inlet and outlet members in communication therewith and for undergoing movement radially outwardly and inwardly relative to the rotor blade tips and said iner portions of said tubular members in response to thermal expansion and contract of said annular ring; and (f) at least one manifold having an elongated hollow body disposed within said annular hollow ring in said annular channel and being connected at the interior of said hollow body of said manifold in communication with only said tubular inlet member for receiving cooling air flow therefrom into said interior of said hollow body of said manifold so as to prevent introduction of the cooling gas flow into said annular hollow ring about the exterior of said hollow body directly form said tubular inlet member without first passing through said interior of said hollow body of said manifold, said hollow tubular body of said manifold also having a plurality of jet-like apertures defined through said hollow body for permitting communication of the cooling air flow from the interior to the exterior of said hollow body of said manifold and impingement of the cooling air flow upon portions of said annular ring adjacent to said apertures and the exterior of said hollow body such that after such impingement the cooling air can flow directly form said annular ring through said tubular outlet member to the exterior of said annular channel without again passing through said interior of said hollow body of said manifold;

(c) said inner portion of said hollow tubular outlet member extending radially inwardly through said third structure and into said annular channel to said annular hollow ring disposed within said channel, and said inner portion of said hollow tubular inlet extending radially inwardly through said third structure and into said annular channel to said annular hollow ring disposed within said channel and therefrom into said hollow body of said manifold disposed within said annular hollow ring such that said tubular inlet member is capable of introducing the cooling gas flow directly into the interior of said hollow body of said manifold from the exterior of said annular channel and said tubular outlet member is capable of exhausting the cooling gas flow directly from the interior of said annular hollow ring to the exterior of said annular channel.

13. The apparatus as recited in claim 12, wherein said hollow body of said manifold also has a plurality of protrusions projecting outwardly form the exterior of said hollow body of said manifold for engaging the interior of said annular ring to define a space for flow of the cooling air between the annular ring interior and the exterior of said hollow body of said manifold.

14. The apparatus as recited in claim 12, wherein said annular ring includes a pair of annular parts each defining one of a pair of opposite side walls of said ring, one of said annular parts defining an outer wall of said ring, the other of said annular parts defining an inner wall of said ring.

15. The apparatus as recited in claim 14, wherein said outer wall of said one annular part of said annular ring includes a pair of tubular portions interfitting with said inner portions of said tubular inlet and outlet members so as to permit differential movement of said annular ring relative to said tubular inlet and outlet members upon thermal expansion and contraction of said annular ring.

16. The apparatus as recited in claim 15, further comprising:

at least one sealing ring mounted about each of said inner portions of said tubular inlet and outlet members and being capable of circumferentially expanding and contracting as said annular ring undergoes thermal expansion and contraction for maintaining a seal between said annular ring and said tubular inlet and outlet members.

17. The apparatus as recited in claim 12, further comprising:

interengagable elements on said first and second structures and said annular ring for forming a stop to limit the amount of contraction and thus radially inward movement of said annular ring and said shroud segment toward the rotor blade tips.

18. The apparatus as recited in claim 12, further comprising:

a pair of expandable and contractible sealing elements disposed in said annular channel between said first and second structures and opposite sides of said annular ring for providing a restriction to air flow through said channel past the exterior of said annular ring while permitting thermal expansion and contraction of said annular ring.

* * * * *